United States Patent [19]

Clarke et al.

[11] Patent Number: 4,698,956

[45] Date of Patent: Oct. 13, 1987

[54] COMPOSITE YARN AND METHOD FOR MAKING THE SAME

[75] Inventors: Steven R. Clarke, Waverly, Pa.; John B. Price, Lubbock, Tex.; Robert A. Sallavanti, Dalton; Stephen P. Zawislak, Philadelphia, both of Pa.

[73] Assignee: Gentex Corporation, Carbondale, Pa.

[21] Appl. No.: 867,942

[22] Filed: May 29, 1986

[51] Int. Cl.[4] ..... D01H 1/13; D02G 3/04; D02G 3/38

[52] U.S. Cl. ..... 57/2; 57/255; 57/315; 57/350; 57/351; 57/403; 57/405

[58] Field of Search ..... 57/252, 254, 255, 256, 57/2, 5, 6, 400, 401, 403, 408, 409, 315

[56] References Cited

U.S. PATENT DOCUMENTS

| | | | |
|---|---|---|---|
| 2,260,229 | 10/1941 | Nutter et al. | 57/315 X |
| 2,305,312 | 12/1942 | Kern | 57/2 X |
| 3,492,804 | 2/1970 | Landwehrkamp et al. | 57/403 X |
| 3,596,458 | 8/1971 | Hiroshi et al. | 57/315 X |
| 3,605,395 | 9/1971 | Morikawa et al. | 57/409 |
| 3,650,104 | 3/1972 | Shepherd et al. | 57/2 X |
| 3,768,246 | 10/1973 | Tabata et al. | 57/409 |
| 3,822,543 | 7/1974 | Edagawa et al. | 57/315 X |
| 3,864,902 | 2/1975 | Wehling et al. | 57/252 X |
| 4,457,345 | 7/1984 | Blucher et al. | 57/255 X |

*Primary Examiner*—Donald Watkins
*Attorney, Agent, or Firm*—Shenier & O'Connor

[57] ABSTRACT

A continuous process of making a blended yarn of staple fiber and long-fiber or filamentary material in which the long-fiber or filamentary material is passed through a rupture zone to produce lengths thereof which are fed directly into an air stream with the staple fibers to produce an intimate blend which is conveyed by the air stream directly to an open end spinning device which produces the yarn.

11 Claims, 5 Drawing Figures

COMPOSITE YARN AND METHOD FOR MAKING THE SAME

FIELD OF THE INVENTION

The invention relates to the field of composite yarns and, more particularly, to a method and apparatus for making a composite yarn such as one incorporating activated carbon fiber.

BACKGROUND OF THE INVENTION

In the past, yarns generally were classified as being either staple fiber yarns or continuous filament yarns. Staple fibers are typified by most of the natural occurring fibers, such for example as cotton, wool, flax and the like. As various man made fibers were introduced, they were chopped into staple form in order to be compatible with the existing processes of opening, carding, drawing and spinning.

Continuous filament yarns usually are formed from synthetic filamentary material or from a naturally occurring filamentary material such, for example, as silk. In order to prepare a continuous filament yarn, a number of filaments are twisted together after extrusion for coherence.

For many years staple fiber yarns and continuous filament yarns have been distinct and separate. Recently, several yarn systems have been developed wherein continuous filamentary material and staple fibers are assembled to the same structure. Examples of such systems are core spinning, wrap spinning, self twist spinning and the like. All of these processes have two common features. First, each of the components, both filamentary and staple fiber material, retains its original form. Secondly, the resultant yarn is heterogeneous.

In many instances blended staple fiber yarns are desirable in that intimate mixtures may be achieved which permit exploitation of the relative merits of the component fibers. One example of such would be a blended polyestercotton yarn which combines the easy care characteristic of polyester with the comfort of cotton. In a blended staple fiber yarn the constituent fibers ideally should be similar in length and in initial modulus or stiffness measured in grams per denier. Where the staple fibers are combined, compatability and length ensures that the proportion of relatively short fibers is minimized for satisfactory processing during the spinning operation. This characteristic ultimately determines the evenness of the yarn and the range of spinning specifications which may successfully be used. Similarity of initial moduli is necessary to ensure that each component fiber makes it proportionate contribution to tensile properties, at least over the normal range of loading in ultimate usage. For these reasons, polyester staple used for blending with cotton generally is an inch-and-a-quarter to an inch-and-a-half in length with relatively high initial modulus whereas staple polyester used for blending with wool is two inches or more in length with a lower initial modulus. Occasionally in composite yarns the ideal of constant fiber modulus is not possible. For example, blends of wool and cotton or nylon and cotton are produced in yarn form. Rarely, however, are fibers of grossly dissimilar length combined.

There exist continuous filamentary materials which, for reason of ultimate use, require blending with other fibers in order to utilize the attributes of staple fiber yarns, particularly those of bulk and cover. In general, such continuous filamentary materials are weak, friable or of high initial modulus and would not withstand the loads imposed during fiber preparation and yarn production. One example of such a continuous filamentary material is filamentary activated carbon.

Activated carbon has long been recognized as an extremely useful material for many purposes owing to its high specific surface area and resultant adsorbent properties. While, strictly speaking, adsorption implies interaction at an outer surface, and absorption refers to introduction into the interstices of a substrate, the mechanism by which activated carbon incorporates foreign substances is such that adsorption occurs both at the outer surfaces as well as those surfaces which are physically continuous with the outer surfaces and yet extend into the body of the activated carbon. Consequently, in this instance the mechanisms of adsorption and absorption become interchangeable. For this reason we have hereafter referred to the incorporation of gases and liquids by activated carbon as adsorption.

Owing to its high degree of adsorbancy, activated carbon is used extensively as an adsorber in air purification, water treatment, chemical filtration, as well as in protective clothing and in filters in the nuclear industry. Since the activated carbon is typically used in the form of granules, powder, or microspheres, difficulty has always arisen in assembling the material into structures which take full advantage of the adsorptive capability of the material. Often, the particulate carbon or its aggregates are entrapped within rigid retaining structures with additional membranes to prevent shifting, sifting or settling, as well as to prevent physical removal of the carbon by the filtration process itself.

In addition to the mechanical methods of holding the carbon material described hereinabove, it is often physically or chemically bonded onto or into a supporting structure such as foam, fabric, paper and the like. By whatever means such bonding is effected, it invariably results in a chemical contamination or occlusion of the carbon which decreases its adsorptivity. Moreover, the bond between the carbon and its supporting substrate is subject to deterioration which often results in loss of carbon.

More recently, activated carbon has been produced in the form of filamentary fibrous activated carbon. This form of the material has the potential of being incorporated within structures owing to its significant length to diameter ratio as compared to that of the particulate form of activated carbon. Heretofore the potential of activated carbon fiber has not been fully realized owing to its inherent friability and resultant loss of material in processing.

SUMMARY OF THE INVENTION

One object of our invention is to provide a method for continuously producing a composite yarn made up of fibers of greatly dissimilar lengths and/or moduli.

Another object of our invention is to provide an improved method of making a composite yarn comprising activated carbon staple fibers and ancillary staple fibers which results in a durable intimately blended yarn.

A further object of our invention is to provide an improved composite yarn of activated carbon staple fibers an ancilliary staple fibers.

Still another object of our invention is to provide an apparatus for carrying out our improved method of continuously producing composite yarns from fibers of greatly dissimilar lengths and/or moduli.

Other and further objects of our invention will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
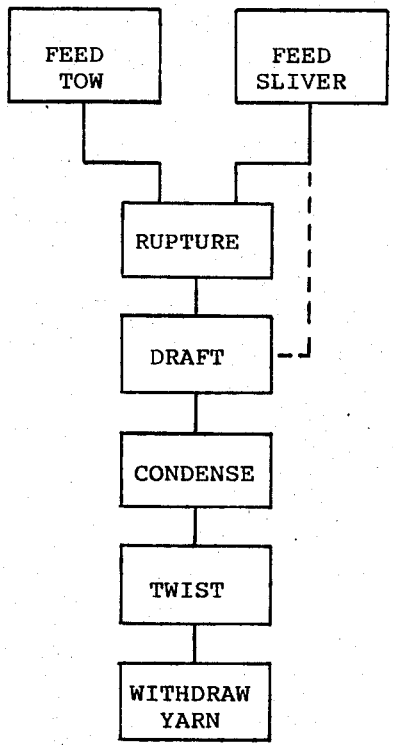
FIG. 1 is a block diagram showing the steps of our improved method of producing a composite yarn.

Referring now to FIG. 1 of the drawings, our continuous method of producing a composite yarn includes the initial step of feeding a tow of filamentary material together with a sliver of staple fibers into a rupture zone. In this zone the filamentary material is ruptured or otherwise formed into relatively short lengths. The lengths of filamentary material and the staple fiber then is fed directly into a drafting zone in which the lengths of filamentary material are intimately blended with the stapled fiber. It is to be noted, as indicated by the broken line in FIG. 1, that the sliver need not be fed into the rupture zone together with the tow but may be fed into the drafting zone together with the ruptured filamentary material.

From the drafting zone the blended lengths of filamentary material and lengths of fiber are fed to a condensing zone in which the fibers and lengths of filament are collected and further intimately blended. The lengths of filamentary material and fiber which are collected in the condensing zone are twisted to form the composite yarn which is then withdrawn as the finished product of our process.

Figure 2:
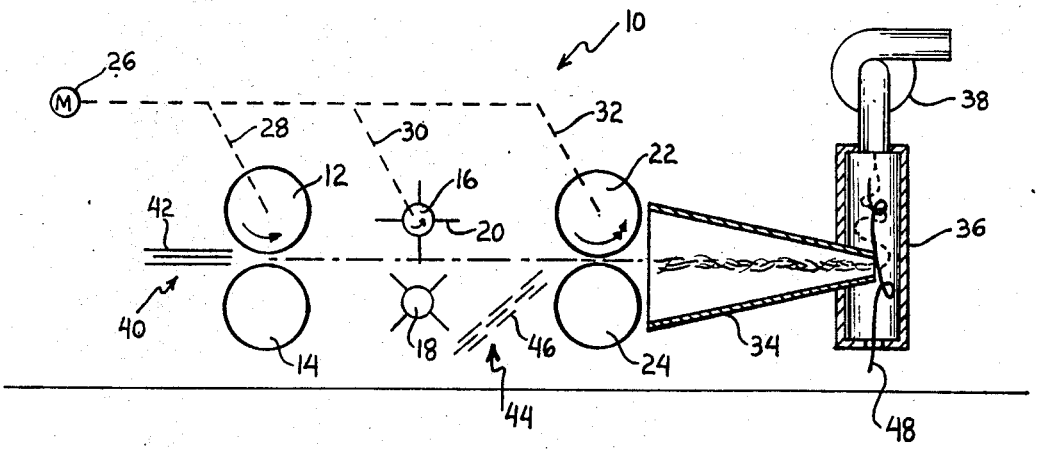
FIG. 2 is a partially schematic view of one form of apparatus which may be employed to carry out our method of producing a composite yarn.

Referring now to FIG. 2, one form of apparatus indicated generally by the reference character 10 which may be used to practice our improved method, includes a pair of feed rolls 12 and 14 which are adapted to advance filamentary material into a rupture zone in which we position a pair of interdigitating breaker rolls 16 and 18 having blades 20. A pair of delivery rolls 22 and 24 are adapted to deliver fiber from the breaker zone.

In the particular embodiment shown in FIG. 2, we may, for example, include a drive motor 26 having a first takeoff 28 which drives the rolls 12 and 14, the second takeoff 30 which drives the rolls 16 and 18 and a third takeoff 32 which drives the rolls 22 and 24. We so arrange this drive system that rolls 22 and 24 are driven at a somewhat greater speed than are the rolls 12 and 14 so as to tension the filamentary material between the two pairs of rolls to permit the blades 20 of the breaker rolls 16 and 18 so to stress the material that it breaks or ruptures.

In the arrangement illustrated in FIG. 2 we may, for example, feed a tow 40 made up of filaments 42 into the nip between the rollers 12 and 14. We feed a sliver 44 of staple fiber 46 to the nip between the delivery rolls 22 and 24. It will readily be appreciated, as is pointed out hereinabove, that we may feed the sliver 44 into the nip between the rolls 12 and 14 together with the tow 40.

Rolls 22 and 24 deliver the staple fiber and lengths of filamentary material to a guide 34 from which the material passes into a cylindrical housing 36 of a vortex spinning device. An exhaust blower 38 connected to the interior of the housing 36 produces a stream of air in the guide 34 which draws the fiber and filamentary lengths as they pass through the guide to the cylindrical inner surface of the housing 36. The guide 34 and the inner surface of housing 36 form an air vortex leading upwardly to the exhaust blower 38 intimately to blend the fibers and to twist them together to form the yarn 48 which is drawn outwardly through an opening in the bottom of housing 36.

Figure 3:
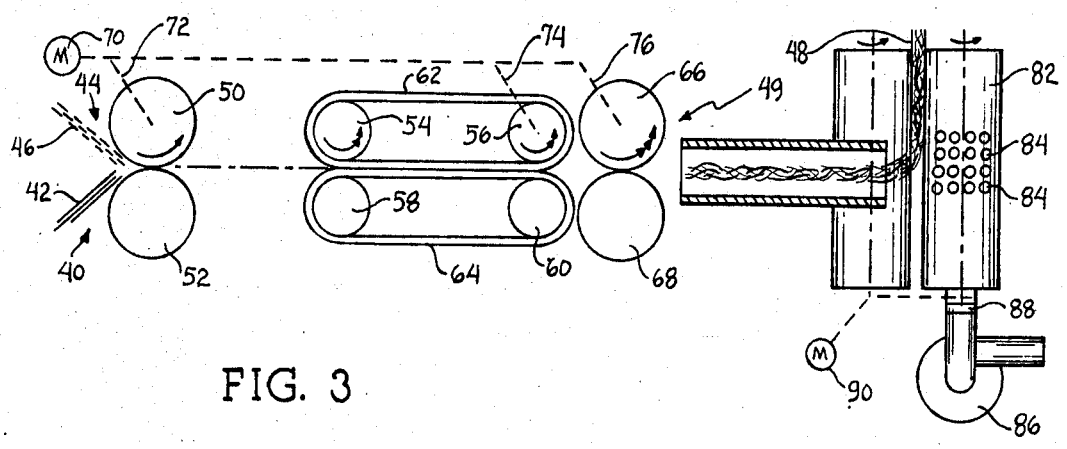
FIG. 3 is a partially schematic view of an alternate embodiment of the apparatus which may be employed to carry out our improved method of producing a composite yarn.

Referring now to FIG. 3, in a second embodiment of apparatus adapted to carry out our continuous method of making a composite yarn, tow 40 and the sliver 44 may be fed together into the nip between a pair of feed rolls 50 and 52 which advance the material into the rupture zone. In this embodiment we arrange a pair of upper rolls 54 and 56 in cooperative relationship with a pair of lower rolls 58 and 60. The upper rolls 54 and 56 carry an upper apron 62 while the lower rolls 58 and 60 carry a lower apron 64. Following the apron 62 and 64 in the direction of movement of the fibrous material is a pair of delivery rolls 66 and 68.

A motor 70 drives three takeoffs 72, 74 and 76 associated respectively with the pairs of rollers 50 and 52, 56 and 60, and 66 and 68. Moreover, in this arrangement the takeoffs are such that the aprons 62 and 64 are driven at a surface speed which is greater than that of the rollers 50 and 52, while the rollers 66 and 68 are driven with a surface speed which is somewhat greater than that of the apron 62 and 64. It will readily be appreciated by those skilled in the art that the relative speeds may be adjusted in any suitable manner. The action of the aprons 62 and 64 and the rollers 66 and 68 relative to the rollers 50 and 52 is such as to produce a stretch breaking of the filaments 42 of the tow 40 as it passes through the rupture zone in the space between the nip of rollers 50 and 52 and the nip of rollers 66 and 68.

Rollers 66 and 68 deliver the staple fiber and the broken lengths of filamentary material to an air stream in a guide tube 78. In the course of its movement through the drawing zone occupied by the guide tube 78, the staple fibers and the lengths of filamentary material are intimately blended.

After leaving the guide tube 78, the fibers are condensed on the collection surface formed by a pair of friction spinning rollers 80 and 82. Roller 82 is hollow and is formed with a plurality of perforations 84 through which air is drawn by an exhaust blower 86 connected to the interior of the roller 82 by means of a coupling 88. A motor 90 drives any suitable gear train or the like known to the art to cause the rollers 80 and 82 to rotate in the same direction to impart a twist to the fibers delivered to the collection surface of the rollers so as to produce the yarn 48.

Figure 4:
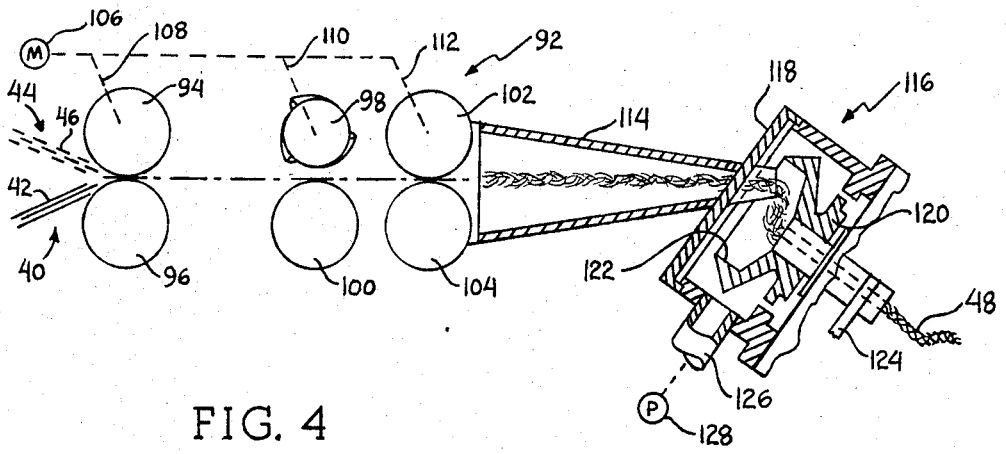
FIG. 4 is a partially schematic view of a third embodiment of the apparatus which may be employed to carry out our improved method of producing a composite yarn.

Referring now to FIG. 4, in a third embodiment of an apparatus adapted to carry out our continuous method of forming a composite yarn, the tow 40 and sliver 46 may be fed together into the nip between a pair of feed rolls 94 and 96 which advance the material into the breaker zone. In this embodiment of our apparatus, we mount a cutting roller 98 having helical blades in the fiber rupture zone for cooperation with an anvil roller 100 to cut the filaments 42 into relatively short lengths as the tow 40 passes through the zone. Delivery rollers 102 and 104 carry the staple filament and lengths of filamentary material out of the rupture zone. A motor 106 has takeoffs 108, 110 and 112 for driving the pairs of rollers 94 and 96, 98 and 100, and 102 and 104. It will readily be appreciated that there is no need in principle for a speed differential between the pairs of rollers in this embodiment of our apparatus since the rupture of the fibers takes place by cutting rather than by stretch-breaking, although a speed differential may be employed to maintain control over the fibers.

After leaving the delivery rollers 102 and 104, the staple fiber and the cut filamentary material passes into a guide 114 in which an air stream intimately blends the fibers in a drawing zone. After the fibers pass through the drawing zone they are delivered to a spinner 116.

Spinner 116 includes a housing 118 in which we mount a rotor 120 having a collection surface 122 to which the intimately blended fibers are delivered by the air stream passing through the guide 114. A belt 124 or the like drives the rotor 120 so that the fibers delivered to the surface 122 are spun into the yarn 48 which is drawn outwardly through an axial opening in the shaft of the rotor 120. A tube 126 communicating with the interior of the housing 118 is connected to an exhaust pump 128 or the like to draw air out of the housing to produce the air stream in the guide 114.

Figure 5:
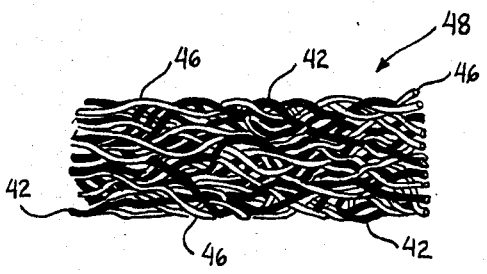
FIG. 5 is an enlarged view of a length of yarn produced by our improved method.

Referring to FIG. 5, it will readily be seen that the finished yarn 48 is made up of a plurality of staple fibers 46 which are intimately blended with lengths of the filamentary material 42.

It is to be understood that the tow 40 is made up of long-fibered material or continuous filamentary material. By long-fibered material we mean material made up of lengths greater than about four inches. Examples of such materials which are naturally occurring would be ramie and mohair. Activated carbon fibrous material may be available in the form of ten to twelve inch lengths as well as in continuous filament form.

In each of the arrangements we employ, fibers longer than about four inches will be shortened. In the arrangement of FIG. 2, such long-fiber or filamentary material is sufficiently tensioned between the pairs of rolls 12, 14 and 22, 24 that the action of the blades or paddles causes the material to rupture. In the embodiment of FIG. 3 the breaking may occur when the trailing portion of a length is in the nip between rolls 50 and 52 and the leading portion is sufficiently frictionally engaged between the aprons 62 and 64. Similarly a length, the leading portion of which is in the nip between the delivery rolls 66 and 68, may be sufficiently frictionally held by the aprons as to be broken. The use of aprons has the advantage of controlling the relatively short staple fiber.

It is to be emphasized that ours is a continuous process which involves no interruption in the flow of fibrous material from the inlet feed rolls to the location at which the spun yarn 48 emerges. Owing to that fact we are able to blend fibers of greatly dissimilar length, such as the short staple fiber with long-fiber or filamentary material. Similarly, fibers with a low (normal) modulus can be combined with fibers of unusually high modulus.

Typical operating conditions for the apparatus shown would be a fiber delivery speed of 1200 meters/minute, a twist insertion rate of 25,000 rpm, a draft of 124:1 and a twist multiplier of 3.61 in producing yarn at a rate of 41 yards per minute. It will readily be appreciated that the machine speeds can be varied. We have produced yarn at rates which have ranged from 20 to 65 yards per minute. Following are a number of examples of yarns which we have made by our process.

EXAMPLE 1

An intimate blend yarn was spun from 25% polyacrylonitrile-based activated carbon fiber filamentary material in continuous tow form and Nomex staple fiber, Type 456, 2 inch staple length, 1.5 denier per filament into a 17/1 cotton count yarn (14,280 yds/lb). The activated carbon fiber is approximately 0.5 denier per filament with a tensile strength of three grams per denier and a specific surface area of approximately 800 $m^2$/gm. Nomex is the registered trademark of E. I. du Pont de Nemours & Co. Inc. for aramid fiber. The resultant yarn was two-plied into a 17/2 cotton count yarn having a breaking strength of 2.8 pounds and a breaking elongation of 15%.

EXAMPLE 2

15% Kynol-based activated fiber filamentary-lengths, 1 denier per filament and 85% PBI staple fiber 1.5 denier per filament were spun into a 22/1 cotton count yarn (18,480 yds/lb). The activated carbon fiber was continuous in length, having a tensile strength of 1.9 gms/denier and a surface area of 1000 $m^2$/gm. Kynol is the registered trademark of Gun-ei Chemical Industry Co. for a novoloid product. PBI is the registered trademark of Celanese Corporation for polybenzimidazole fiber.

EXAMPLE 3

An intimate blend yarn was spun from 30% pitch-based activated carbon fiber filamentary material in 10 to 12 inch lengths and 70% permanently flame retardant rayon staple fiber into a 25/1 cotton count yarn.

EXAMPLE 4

The blend of Example 3 was spun into yarn having a cotton count of 22/1.

While our process is especially adapted for use in producing yarns made up of activated carbon fiber and staple fiber, it is also applicable to the continuous production of composite yarns of long-fibered material, the fibers of which may be considered as lengths of filamentary material and staple fiber. In the continuous process of forming composite yarn from such materials, the long-fibered material is stretch-broken and directly fed to the air stream leading to the spinning device together with the staple fiber to result in the continuous production of a composite yarn of shortened lengths of the long-fibered material and the staple fiber.

EXAMPLE 5

A sliver of 100% ramie fiber having a fiber length in excess of five inches was fed to the apparatus together with a sliver made up of 50% cotton and 50% 1.5 denier 1½" polyester to produce a composite yarn of ramie, cotton and polyester.

EXAMPLE 6

A composite yarn was continuously formed from separate slivers of mohair and 3 denier 2" polyester fiber to produce the yarn of shortened mohair fibers and polyester.

The yarns produced according to the above examples may be used in numerous applications. As has been pointed out hereinabove, the blended activated carbon fiber yarns produced by our process may be used as is or they may be incorporated into fabrics. The two-plied yarn of Example 1 was used as both the warp and the filling of a 2/2 right hand twill fabric weighing 6.6 oz/yd$^2$. The same yarn produced by Example 1 was used in a circular knit jersey fabric weighing 7.6 oz/yd$^2$. The same yarn was used in the manufacture of a pile fabric in conjunction with a nylon base fabric structure weighing 5.5 oz/yd$^2$. It was used in the manufacture of a warp-knit fabric weighing 8 oz/yd$^2$. The yarn of Example 2 was three-plied for the warp and two-plied for the filling to make plain woven fabric weighing 7.0 oz/yd$^2$. The yarn of Example 3 was woven into a double cloth fabric weighing 13.2 oz/yd$^2$ with a 3 ply warp and a 2 ply filling. Yarns of Example 4 were laid into machine direction of a thermobonded nonwoven between two webs of 100% polyester. The resultant structure weighed 8.5 oz/yd$^2$. The yarns of Examples 5 and 6 were used as filling with an all cotton warp.

It will be seen that we have accomplished the objects of our invention. We have provided a method of continuously forming a composite yarn from fibers of greatly dissimilar lengths. Our method is especially adapted to the production of composite yarn incorporating activated carbon fibers. We have provided an improved composite yarn made by our method.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A continuous process for forming blended yarn from long-fiber or filamentary activated carbon and staple fiber including the steps of passing the long-fiber or filamentary activated carbon through a rupture zone, reducing the long-fiber or filamentary activated carbon to shorter lengths in said rupture zone, passing said shorter lengths of activated carbon directly into an air stream leading from said rupture zone to a fiber collection zone, introducing staple fibers into said air stream with said shorter lengths of activated carbon, maintaining said staple fibers and said shorter lengths of activated carbon in said air stream for a sufficiently long time to result in an intimate blend of staple fibers and activated carbon shorter lengths in said collection zone and continuously spinning said blend to produce said yarn.

2. A continuous process as in claim 1 in which the staple fibers are passed through the rupture zone along with the long-fiber or filamentary activated carbon.

3. A continuous process as in claim 1 in which said length-reducing step comprises stretch-breaking.

4. A continuous process as in claim 2 in which said length-reducing step comprises stretch-breaking.

5. A continuous process as in claim 1 in which said length-reducing step comprises cutting.

6. A continuous process as in claim 2 in which said length-reducing step comprises cutting.

7. A product made by the process of claim 1.

8. A continuous process as in claim 1 in which said spinning step is an open-end spinning step.

9. A continuous process as in claim 8 in which said spinning step comprises spinning in an air vortex.

10. A continuous process as in claim 8 in which said spinning step is a friction spinning step.

11. A continuous process as in claim 8 in which said reducing step comprises stretch-breaking said activated carbon filamentary material and in which said spinning step comprises spinning said blend on an open end spinning device comprising a rotor providing said fiber collection surface.

* * * * *